United States Patent [19]

Götte et al.

[11] Patent Number: 4,524,859

[45] Date of Patent: Jun. 25, 1985

[54] RAIL ASSEMBLY FOR UNDERGROUND COAL-GETTING MACHINES

[75] Inventors: Elmar Götte, Lüdinghausen; Heinrich Schulte, Witten, both of Fed. Rep. of Germany

[73] Assignee: Klöckner-Becorit GmbH, Castrop-Rauxe, Fed. Rep. of Germany

[21] Appl. No.: 656,421

[22] Filed: Oct. 2, 1984

Related U.S. Application Data

[63] Continuation of Ser. No. 373,053, Apr. 29, 1982, abandoned.

[30] Foreign Application Priority Data

Jun. 11, 1981 [DE] Fed. Rep. of Germany ..... 3123122

[51] Int. Cl.[3] ..... B65G 19/18

[52] U.S. Cl. ..... 198/735; 299/43

[58] Field of Search ..... 198/735, 862, 864, 861; 299/42, 43; 105/29 R

[56] References Cited

U.S. PATENT DOCUMENTS

| | | | |
|---|---|---|---|
| 4,082,361 | 4/1978 | Lanfermann | 299/43 |
| 4,155,600 | 5/1979 | Lanfermann et al. | 299/43 |
| 4,186,970 | 2/1980 | Minke et al. | 299/43 |

*Primary Examiner*—Joseph E. Valenza
*Assistant Examiner*—Kyle E. Shane
*Attorney, Agent, or Firm*—Watson, Cole, Grindle & Watson

[57] ABSTRACT

A rail assembly for supporting the wheels of underground wheeled coal-getting machines, in combination with a coal conveyor comprising a plurality of conveyor pans interconnected end-to-end in the direction of movement of the machines with the central axes of adjoining pans being angularly related, the assembly comprising a rail section mounted on each pan with each section including at least three rail elements having adjoining ends interconnected for relative movement along such direction, so that the upper surfaces of the rail sections lie parallel to the central axes of the pans and the rail assembly is thereby made to follow the undulations of the conveyor when mounted in place.

4 Claims, 3 Drawing Figures

RAIL ASSEMBLY FOR UNDERGROUND COAL-GETTING MACHINES

This application is a continuation, of application Ser. No. 373,053, filed Apr. 29, 1982, now abandoned.

BACKGROUND OF THE INVENTION

This invention relates to a rail assembly for underground coal-getting or mining machines, such as wheeled coal-cutting machines, the assembly being mounted on a coal conveyor comprising a plurality of conveyor pans to connected end-to-end, and the assembly comprising a rail section mounted on each pan. Each rail section includes rail elements interconnected for relative longitudinal movement so that the upper surfaces of the rail sections will be made to lie parallel to the central axes of the conveyor pans even when those axes are angularly related.

A known assembly of this general type has each of its rail sections made up of rail elements equal to twice the number of conveyor pans. An element of each section is fixedly mounted on a conveyor pan at the central portion of the pan, and the other rail element spans each joint between adjoining rail sections and is interconnected with the fixed rail elements for longitudinal movement relative thereto and relative to the conveyor. Relative longitudinal movement between the rail elements must be limited to assure a relatively smooth movement of the coal cutter wheels therealong. Thus, the clearance between a pair of adjoining conveyor pans, when the central axes thereof are angularly related to accomodate an undulating conveying path, may be only twice as large as the clearance between the fixed and relatively movable rail elements of the rail sections. However, because of the small clearances between the rail elements which must be maintained, even twice as large clearances between adjoining conveyor pans is too limiting for most applications.

SUMMARY OF THE INVENTION

It is therefore an object of the present invention to provide a rail assembly of the aforementioned type, but which permits greater degrees of angularity between adjoining conveyor pans without affecting the smooth and safe operation of the rolling coal-getting machines.

Another object is to provide such an assembly wherein the rail section for each conveyor pan has at least three rail elements for each pan, and all the rail elements are interconnected for relative longitudinal movement. In such manner, the relative clearances between the rail elements can be small while the angularity between the adjoining conveyor pans can be large to accomodate the undulations along the conveying path.

Each rail section may comprise four of such rail elements, one of the elements being fixedly mounted on each conveyor pan, another of such elements being mounted on each pan for relative movement and being interconnected with the remaining rail elements for relative longitudinal movement. Thus, four clearance spaces are provided at each rail section thereby permitting a greater degree of angular adjustment between adjoining conveyor pans than before. And, relative longitudinal movement of the rail elements is facilitated by the provision of openings which are elongated in the direction of movement of the machines along the rails, are provided at opposite ends of the fixed and movable rail elements for the reception of transverse pins located on the remaining rail elements, the openings being elongated in the direction of movement of the machines along the rail.

Other objects, advantages and novel features of the invention will become more apparent from the following detailed description of the invention when taken in conjunction with the accompanying drawings.

DETAILED DESCRIPTION OF THE INVENTION

Figure 1:
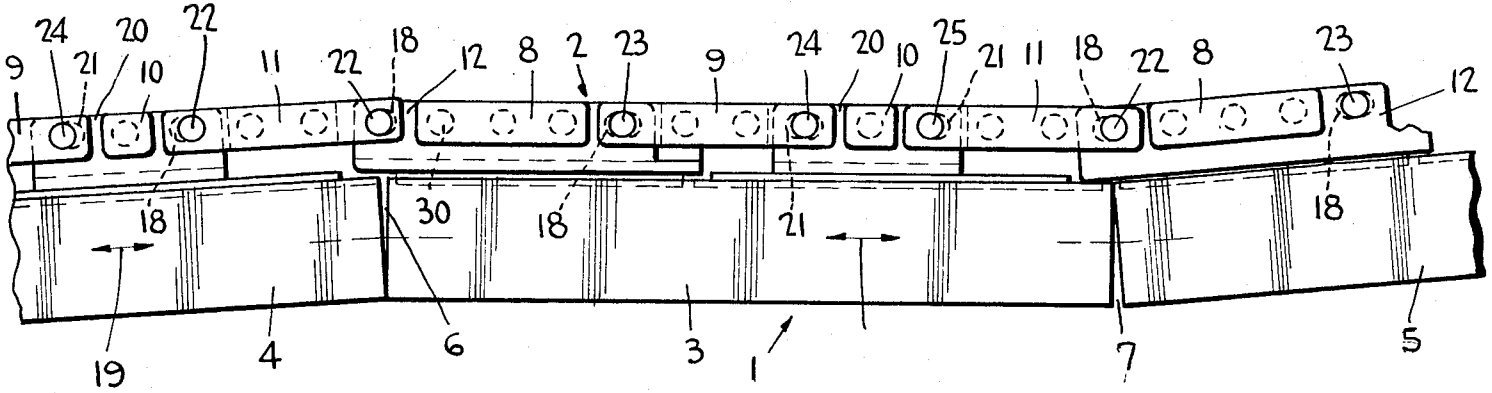
FIG. 1 is a side elevational view of a rail assembly and combined conveyor in accordance with the invention.

Turning now to the drawings wherein like reference characters refer to like and corresponding parts throughout the several views, a coal conveyor generally designated 1 comprises a plurality of adjoining conveyor pans 3, 4 and 5 lying on the ground in the direction of movement of the coal cutting machines (not shown). The pans are interconnected end-to-end in some suitable manner and, due to the unevenness of the ground, adjoining conveyor pans may be angularly related so as to follow the undulations of the ground. The rail surface of a rail assembly 2 mounted to the conveyor must follow the same ground undulations. To illustrate the invention, only three adjoining conveyor pans are shown in FIG. 1 as having an upwardly open angle 6 formed between pans 3 and 4, and a downwardly open angle 7 formed between pans 3 and 5. The extent of these angles is determined by the angularity at the central axes between adjoining conveyor pans.

Figure 2:
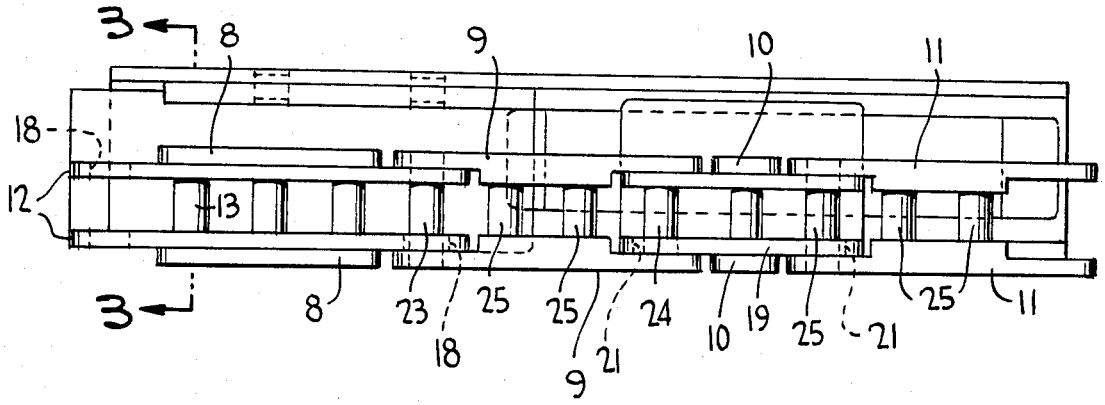
FIG. 2 is a top plan view of the rail assembly of FIG. 1.
Figure 3:
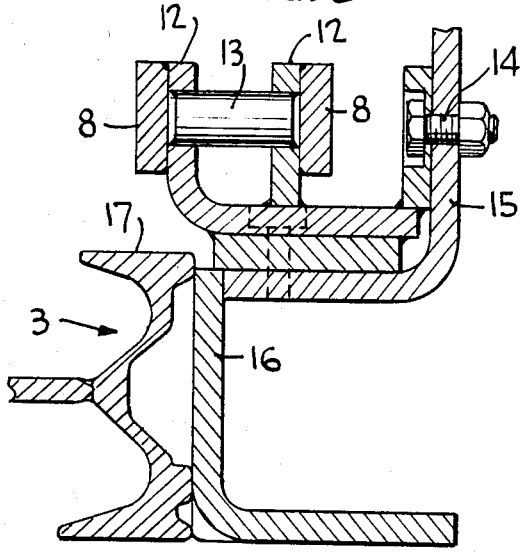
FIG. 3 is a sectional view taken substantially along the line 3—3 of FIG. 2.

Rail assembly 2 includes at least three, and as shown, four rail elements 8, 9, 10 and 11 forming a rail section mounted on each conveyor pan. Element 8, formed of a pair of opposed pieces as shown in FIGS. 2 and 3, is fixedly secured to a connecting element 12, and the spacing between the opposed pieces is maintained by spacer pins 13. Connecting piece 12 is bolted as at 14 to a vertical 15 of a rail 16 which is fixedly secured to a side 17 of the conveyor pan 3.

Thus, rail element 8 is fixedly secured to conveyor pan 3. And, pivot pin openings 18 are provided at opposite ends of connecting piece 12, these openings being elongated in the direction of double arrow 19, the direction of movement of the coal-getting machine (not shown) along the rail assembly. At the opposite end of conveyor pan 3, a connecting piece 20 is mounted for movement relative to the conveyor pan, rail element 10 being fixedly secured to connecting piece 20, and rail elements 8, 9, 10 and 11 being interconnected for movement relative to one another. Openings 21 are provided at opposite ends of connecting piece 20 and are likewise elongated in the direction of double arrow 19. Pivot pins 22, 23 and 24, 25 extend through openings 18 and 21, respectively, for interconnecting the rail elements together. Pivot pins 22 are located directly above openings 6 and 7 between adjoining conveyor pans so that the bends in the conveyor and in the rail assembly are respectively aligned and a play area or clearance space is formed by openings 18 above and between the openings 6 and 7 formed between adjoining conveyor pans.

As with rail element 8, rail elements 9, 10 and 11 each comprise a pair of opposing pieces which, for element 9 and element 10 are spaced apart by spacer pins 25.

The rail section including its rail elements has been described relative to conveyor pan 3, although it can be seen that such an arrangement is equally applicable for conveyor pans 4 and 5 and the remaining pans forming the conveyor. Connecting pieces 12 and 20 are mounted on the conveyor pan at opposite ends as shown, or piece 12 may be fixedly mounted at the right end of the pan and piece 20 may be mounted at the left end of the pan, without departing from the invention. With the present arrangement, it can be seen that the upper surfaces of the rail sections will be made to lie parallel to the central axes of the conveyor pans so that the rail will follow the undulations of the conveyor when in place within the mine.

Obviously, many modifications and variations of the present invention are made possible in the light of the above teachings. It is therefore to be understood that within the scope of the appended claims the invention may be practiced otherwise than as specifically described.

What is claimed is:

1. A rail assembly for supporting the wheels of underground wheeled coal-getting machines, in combination with a coal conveyor comprising a plurality of conveyor pans interconnected end-to-end in the direction of movement of the machines with the central axis of adjoining pans being angularly related, the assembly comprising a rail section mounted on each said pan and a connecting piece mounted for movement relative to each pan, each said section comprising at least three rail elements having adjoining ends interconnected for relative movement along said direction to provide play between adjoining rail sections, whereby the upper surfaces of said rail sections lie parallel to said central axes of said pans and wherein the first of said elements of said section is fixedly mounted on each said pan, the second of said elements of each said section being movably mounted on each said connecting piece, and the third of said elements of each said section lying between said first and second elements and movably mounted to the pan and the connecting piece such that play is provided above and between each of said adjoining pans.

2. The rail assembly according to claim 1, wherein each said rail section comprises four of said rail elements.

3. The rail assembly according to claim 1, wherein openings elongated in said direction of movement are provided at opposite ends of said second and said third elements of each said section, and said second and third elements having transverse pins engaging said openings.

4. The rail assembly according to claim 1, wherein said first element is located at one end of each said pan, and said third element is located at the opposite end of each said pan.

* * * * *